United States Patent [19]

Hayashi et al.

[11] Patent Number: 4,554,245

[45] Date of Patent: Nov. 19, 1985

[54] COLOR REVERSAL LIGHT-SENSITIVE MATERIALS

[75] Inventors: Yasuhiro Hayashi; Naoyasu Deguchi; Hiroyuki Yamagami; Kensuke Goda; Kazunori Hasebe, all of Kanagawa, Japan

[73] Assignee: Fuji Photo Film Co., Ltd., Kanagawa, Japan

[21] Appl. No.: 575,376

[22] Filed: Jan. 30, 1984

[30] Foreign Application Priority Data

Jan. 28, 1983 [JP] Japan ..... 58-12276

[51] Int. Cl.[4] ..... G03C 1/76

[52] U.S. Cl. ..... 430/567; 430/564; 430/600; 430/611; 430/379; 430/504; 430/505; 430/407; 430/508

[58] Field of Search ..... 430/600, 611, 379, 567, 430/571, 504, 505, 407, 564, 508

[56] References Cited

U.S. PATENT DOCUMENTS

| | | | |
|---|---|---|---|
| 3,779,764 | 12/1973 | Moll et al. | 430/567 |
| 3,846,133 | 11/1974 | Zorn et al. | 430/505 |
| 3,888,676 | 6/1975 | Evans | 430/571 |
| 3,945,829 | 3/1976 | Zorn et al. | 430/611 |
| 3,989,527 | 11/1976 | Locker | 430/571 |
| 4,082,553 | 4/1978 | Groet | 430/505 |
| 4,088,494 | 5/1978 | Tani | 430/600 |

*Primary Examiner*—Won H. Louie

*Attorney, Agent, or Firm*—Sughrue, Mion, Zinn, Macpeak and Seas

[57] ABSTRACT

A color reversal photographic light-sensitive material is disclosed. The material is comprised of a support base having thereon a silver halide emulsion layer, an organic compound and colloid grains of a metal or metal sulfide or silver halide grains the surface of which is previously fogged. The silver halide emulsion layer includes fine grains of silver halide particles having a particle size of 0.3μ or less. The fine grain particles are present in the emulsion in an amount in the range of about 30% to about 95% based on the total number of silver halide grains in the emulsion. The silver halide emulsion also includes coarse grains having a particle size of more than 0.3μ. The organic compound has a solubility product constant of $10^{-14}$ or less when forming a salt with a silver ion. By utilizing the organic compound in combination with the particular fine grain silver halide particles it is possible to obtain a material which has improved tone reproduction properties in high exposure areas and also provide a material with a wide exposure lattitude.

16 Claims, 1 Drawing Figure

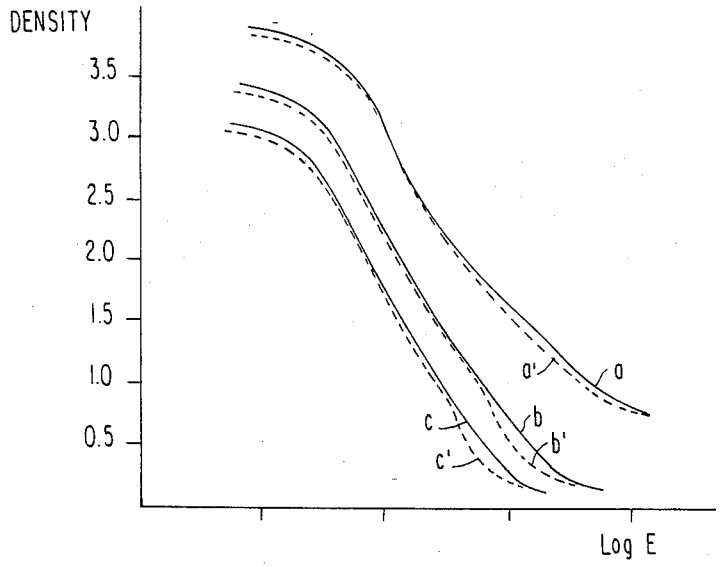
DENSITY
3.5
3.0
2.5
2.0
1.5
1.0
0.5
a'
a
b
b'
c
c'
Log E

COLOR REVERSAL LIGHT-SENSITIVE MATERIALS

FIELD OF THE INVENTION

The present invention relates to color reversal light-sensitive materials and particularly to color photographic light-sensitive materials having improved tone reproduction in high exposure areas.

BACKGROUND OF THE INVENTION

The color reversal light-sensitive materials include those having a construction composed of a silver halide emulsion layer forming monochromatic dye images. However, such materials are generally prepared by applying a red-sensitive emulsion layer forming a cyan dye image by exposing to red light, a green-sensitive emulsion layer forming a magenta dye image by exposing to green light and a blue-sensitive emulsion layer forming a yellow dye image by exposing to blue light to a base. Further, in the silver halide color reversal light-sensitive materials, an antihalation layer composed of a colloid of metal or metal sulfide or a yellow filter layer is generally provided. Moreover, to the above described emulsion layers, if necessary, colloid particles of metal or metal sulfide are added as described in U.S. Pat. No. 3,846,133 or a small amount of silver halide emulsion the surface of which is previously fogged is added as described in U.S. Pat. No. 4,082,553.

One method of giving a wide exposure latitude to the above described color reversal light-sensitive materials comprises using a silver halide emulsion comprising two or more kinds of silver halide which each have the same color sensitizing property and different sensitivity, namely, light-sensitive silver halide having a smaller particle size and light-sensitive silver halide having a larger particle size.

However, according to experiments by the present inventors, it has been found that, in the color reversal light-sensitive materials using the above described technique, dye image densities of high exposure parts are lower than the expected values and, further, gradation of the foot part of characteristic curves becomes softer than necessity and, consequently, correct tone reproduction cannot be obtained. This fault appears remarkably when emulsions containing light-sensitive fine grain silver halide having a particle size of 0.3$\mu$ or less in an amount of about 30% to 95% of the whole number of silver halide grains are used.

In the color reversal light-sensitive materials, since the high exposure area corresponds to a low density area where the difference of densities can be easily recognized by the naked eye, appearance of the above described fault in this area causes remarkable deterioration of quality.

SUMMARY OF THE INVENTION

A primary object of the present invention is to provide color reversal light-sensitive materials having improved tone reproduction in high exposure areas and a wide exposure latitude.

The above described object of the present invnetion has been attained by providing color reversal photographic light-sensitive materials comprising at least one silver halide emulsion layer containing light-sensitive fine grain silver halide having a particle size of 0.3$\mu$ or less and light-sensitive coarse grain silver halide having a particle size of more than 0.3$\mu$, wherein said emulsion layer or another hydrophilic colloid layer contains colloid grains of metal or metal sulfide or silver halide grains the surface of which is previously fogged. The content of the fine grain silver halide in said emulsion layer is in a range of about 30% to about 95% of the total number of silver halide grains in the emulsion layer, and the emulsion layer contains an organic compound having a solubility product constant of $10^{-14}$ or less in case of forming a salt with a silver ion.

BRIEF DESCRIPTION OF THE DRAWING

The FIGURE is a graph which indicates characteristic curves of magenta images in Samples 1 and 2 of the Example in this specification.

DETAILED DESCRIPTION OF THE INVENTION

The fine grain silver halide and the coarse grain silver halide in the present invention are used in the above described ratio in the same emulsion layer. The preferred content of fine grain silver halide is in a range of about 40% to about 90% of the total number of silver halide grains in the emulsion layer.

Here, the particle size of silver halide is represented by the grain diameter when the grain is spherical or nearly spherical and by the side length$\times\sqrt{4/\pi}$ when the grain is cubic, which is a value calculated from the projected area of each grain. Details of measurement of the particle size are described in *The Theory of the Photographic Process,* 3rd Edition, pages 36 to 43 (1966), written by C. E. Mees and T. H. James, published by Macmillan Co., and *Shashin Kogaku no Kiso* (Ginenshashin), edited by Japan Photography Society, pages 277 and 278 (1979), published by Corona Co., and the report in *The Photographic Journal,* Vol. 79, pages 330 to 338.

The fine grain silver halide component in the emulsion layer of the present invention is preferred to have an arranged particle size. It is particularly preferred that 90% or more (number) of grains having a particle size of 0.3$\mu$ or less has a particle size in a range of 0.3 to 0.15$\mu$.

The emulsion containing fine grain silver halide and coarse grain silver halide of the present invention can be prepared by various methods. As a simple sure method, there is a method which comprises preparing a fine grain silver halide emulsion and a coarse grain silver halide emulsion, respectively, and mixing them so as to have the above described ratio at a suitable time before application. Preparation of the fine grain silver halide emulsion and the coarse grain silver halide emulsion can be carried out by methods known in this field. For example, there are methods described in P. Glafkides, *Chimie et Physique Photographique,* (published by Paul Montel Co., 1967), G. F. Duffin, *Photographic Emulsion Chemistry* (published by The Focal Press, 1966), and V. L. Zelikman et al., *Making and Coating Photographic Emulsion* (published by The Focal Press, 1964), etc.

Namely, any of an acid process, a neutral process and an ammonia process may be used. Further, as a way of reacting soluble silver salts with soluble halogen salts, any of a single jet mixing process, a double jet mixing process and a combination of them may be used.

A process of forming grains in the presence of excess silver ions (the so-called reversal mixing process) can be used, too. As a type of the double jet mixing process, it is possible to use a process wherein the pAg of the liquid phase of forming silver halide is kept at a constant value, namely, the so-called controlled double jet process.

According to this process, silver halide emulsions having a regular crystal form and a uniform particle size are obtained.

In the present invention, it is preferred that at least the fine grain silver halide emulsion is the so-called monodisperse emulsion, and it is particularly preferred that the particle size of grains occupying 90% or more of the total number of grains in the fine grain silver halide emulsion is in a range of ±40% and preferably ±30% of the average particle size of the fine grain silver halide emulsion. Accordingly, the above described controlled double jet process is particularly suitable for preparation of the fine grain silver halide emulsions.

Formation of silver halide grains or physical aging thereof may be carried out in the presence of cadmium salts, zinc salts, lead salts, thallium salts, iridium salts or complex salts thereof, rhodium salts or complex salts thereof or iron salts or complex salts thereof, etc.

After formation of the emulsion by precipitation or after physical aging of the emulsion, soluble salts are generally removed. Means for removal include the well known noodle water wash process in which gelatin is gelatinized may be used. Further, a precipitation process (flocculation) utilizing inorganic salts of polyvalent anions, such as sodium sulfate, anionic surface active agents, anionic polymers (for example, polystyrenesulfonic acid) or gelatin derivatives (for example, aliphatically acylated gelatin, aromatically acylated gelatin or aromatically carbamoylated gelatin, etc.) may be used, too. The process for removal of soluble salts may be omitted.

In order to carry out chemical sensitization, a sulfur sensitization process using sulfur containing compounds capable of reacting with silver ions or active gelatin, a reduction sensitization process using reducing substances, and a noble metal sensitization process using compounds of noble metal such as gold, etc., can be used alone or as a combination of them.

They have been described in the above described literature written by Glafkides and Zelikman et al., and *Die Grundlagen der Photographischen Prozesse mit Silberhalogeniden,* edited by H. Frieser (Akademische Verlagsgesellschaft, 1968). As the sulfur sensitizers, thiosulfates, thioureas, thiazoles, rhodanines and other compounds can be used. Examples of them have been described in U.S. Pat. Nos. 1,574,944, 2,410,689, 2,278,947, 2,728,668 and 3,656,955. As the reduction sensitizers, stannous salts, amines, formamidine sulfinic acid and silane compounds, etc., can be used. Examples of them have been described in U.S. Pat. Nos. 2,487,850, 2,518,698, 2,983,609, 2,983,610, 2,694,637, 3,930,867 and 4,054,458. For noble metal sensitization, not only gold complex salts but also complex salts of metals of Group VIII in the Periodic Table (short periodic type) such as platinum, iridium or palladium, etc., can be used. Examples of them have been described in U.S. Pat. Nos. 2,399,083 and 2,448,060 and British Pat. No. 618,061.

The silver halide grains may have a regular crystal form such as a cube or octahedron, or may have an irregular crystal form such as sphere or plate, etc. Further, they may have a composite crystal form of them. They may be composed of a mixture of grains having various crystal forms.

The silver halide grains may have a structure wherein the inner part and the surface layer each have a different phase, or may be composed of a uniform phase.

The fine grain silver halide and the coarse grain silver halide in the present invention may be composed of any of silver chloride, silver bromide, silver chlorobromide, silver iodobromide and silver chloroiodobromide. The fine grain silver halide and the coarse grain silver halide are preferred to have the same kind of halogen ion. When two or more kinds of halogen ions are present (for example, silver iodobromide), it is possible to change the ratio of each halogen ion between the fine grain silver halide and the coarse grain silver halide.

In a particularly preferred embodiment of the present invention, the emulsion containing fine grain silver halide and coarse grain silver halide together is prepared by blending a monodisperse fine grain silver halide emulsion with a coarse grain silver halide emulsion. As the monodisperse fine grain silver halide emulsion, that having an average particle size of 0.3μ or less is used. It is particularly preferred to have 0.25μ or less. On the other hand, the coarse grain silver halide emulsion may be either the monodisperse emulsion or the polydisperse emulsion, which has an average particle size of more than 0.3μ. It is particularly preferred to have an average particle size of 0.35μ to 0.7μ. A preferred ratio of the mixture of the monodisperse fine grain silver halide emulsion and the coarse grain silver halide emulsion is in a range of fine grain/coarse grain=4/1 to $\frac{2}{3}$ by silver weight.

In the present invention, an organic compound having a solubility product constant of $10^{-14}$ or less in case of forming a salt with silver ion is added to the silver halide emulsion layer containing the above described fine grain silver halide and the coarse grain silver halide in a specified ratio. When organic compounds having a solubility product constant of more than $10^{-14}$ in case of forming a salt with silver ion (for example, 5-methylbenzotriazole; solubility product constant: about $10^{-13}$) is used, the object of the present invention cannot be attained. Particularly preferred organic compounds are those having a solubility product constant of $10^{-15}$ or less in case of forming a salt with silver ion.

Although such organic compounds are known as photographic additives, an effect of improving tone reproduction of the high exposure area in the color reversal light-sensitive materials having an emulsion layer having a specific distribution of particle size as prescribed in the present invention is not known at all.

In a preferred embodiment of the present invention, the above described organic compound is added to the fine grain silver halide emulsion during preparation thereof. Most preferably, it is added during physical aging of the fine grain silver halide emulsion.

As examples of useful organic compounds, there are 2-mercaptobenzimidazole compounds, 2-mercaptobenzothiazole compounds, 2-mercaptobenzoxazole compounds and 5-mercaptothiadiazole compounds, especially 5-mercapto-1,3,4-thiadiazole derivatives. Among them, compounds represented by the following general formulae are particularly preferred.

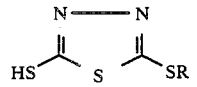

-continued

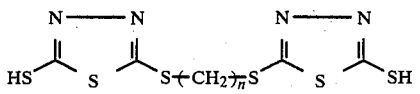

wherein R represents an alkyl group (preferably, that having 1 to 4 carbon atoms) or an aralkyl group (preferably, an aralkyl group in which the alkyl moiety has 1 to 4 carbon atoms, for example, a benzyl group), and n represents an integer of 2 to 10.

Specific examples of these organic compounds include the following:

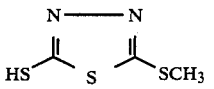

(1)

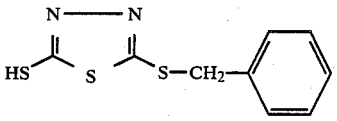

(2)

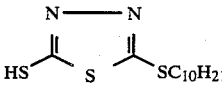

(3)

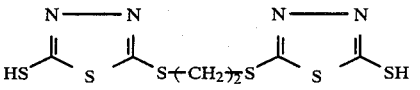

(4)

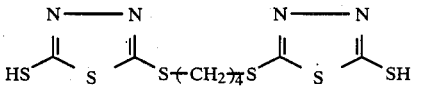

(5)

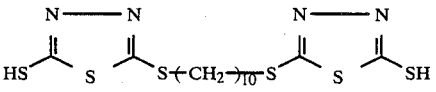

(6)

Since the 5-mercapto-1,3,4-thiadiazole derivatives cause less desensitization, they are particularly excellent as the organic compounds of the present invention.

The amount of the organic compound used in the present invention can be varied over a wide range according to the kind of the compound and the content of the fine grain silver halide, but is generally used in a range of $10^{-6}$ mg to 1 mg and, preferably, $10^{-4}$ mg to $10^{-2}$ mg per $dm^2$ of a support.

The color reversal light-sensitive materials of the present invention may have a simple layer construction which is prepared by applying a metal or metal sulfide colloid layer (for example, a colloidal silver layer or a colloidal silver sulfide layer) for antihalation and the above described emulsion layer containing fine grain silver halide and coarse grain silver halide to a support, but it is generally preferred to have a layer construction using for the so-called multilayer color reversal light-sensitive materials. Namely, in color reversal light-sensitive materials comprising an antihalation layer, a red-sensitive emulsion layer forming a cyan dye image by exposing to red light, a green-sensitive emulsion layer forming a magenta dye image by exposing to green light, a yellow filter layer and a blue-sensitive emulsion layer forming a yellow dye image by exposing to blue light which are superposed on a support, at least one of the above described red-sensitive emulsion layer, green-sensitive emulsion layer and blue-sensitive emulsion layer is a mixed emulsion layer composed of fine grain silver halide and coarse grain silver halide as prescribed in the above, and the mixed emulsion layer or another layer contains colloid grains of metal or metal sulfide (concretely, colloidal silver or colloidal silver sulfide) or silver halide grains the surface of which is previously fogged.

The above described red-sensitive emulsion layer, the green-sensitive emulsion layer and the blue-sensitive emulsion layer may be divided each into a higher speed layer and a lower speed layer, but the effect of the present invention becomes particularly remarkable when the mixed emulsion layer comprising fine grain silver halide and coarse grain silver halide is used as the above described lower speed emulsion layer.

In the most preferred embodiment of the present invention, a mixed emulsion layer comprising fine grain silver halide and coarse grain silver halide which contains an organic compound of the present invention is used as a low speed emulsion layer adjacent to an intermediate layer containing silver halide the surface of which is previously fogged which is provided for preventing interlayer migration of sensitizing dyes as described in Japanese Patent Application No. 10091/83 filed on Jan. 25, 1983 by the present applicant.

In the above Japanese Patent application, it is disclosed that at least one of the green-sensitizing dye and the red-sensitizing dye used there has at least two water-solubilizing groups. The water-solubilizing group means preferably carboxy group and sulfo group.

Such sensitizing dyes having at least two water-solubilizing groups are known which have been described in, for example, U.S. Pat. Nos. 3,655,394, 3,656,956, 3,672,897, 3,649,217 and 3,667,960 and Japanese Patent Publication No. 14030/69, etc.

The sensitizing dyes used in the above Japanese Patent application are dissolved in water or water-soluble organic solvents such as methanol, ethanol, acetone, methyl cellosolve or pyridine, etc., and added to the silver halide emulsion, as a mixture or respectively. In order to dissolve the sensitizing dyes, stirring by ultrasonic wave can be adopted. The amount to be added, the order of addition and the step for adding can be suitably changed according to the purpose. It is preferred that the amount of the sensitizing dyes used is generally in a range of $1\times10^{-6}$ mol to $5\times10^{-4}$ mol per mol of silver halide.

The effect described in the above Japanese Patent Application is remarkably shown when red-sensitizing dyes represented by the following general formula (I) are used.

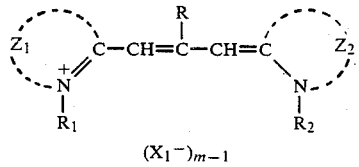

(I)

In the formula, R represents a lower alkyl group (for example, a methyl group or an ethyl group, etc.), a phenyl group or a hydrogen atom, $R_1$ and $R_2$ each represents an alkyl group (for example, a methyl group, an ethyl group or a propyl group, etc.) or an alkyl or alkoxyalkyl group having at least one of sulfo group and carboxyl group (for example, a carboxymethyl group, a 3-carboxypropyl group, a 4-carboxybutyl group, a 3-sulfopropyl group, a 1-sulfobutyl group, a 3-sulfobutyl group, a 2-(3-sulfopropoxy)ethyl group or a 2-hydroxy-3-sulfopropyl group, etc.), and at least one of $R_1$ and $R_2$ represents an alkyl group having at least one of sulfo group and carboxyl group.

$Z_1$ represents an atomic group necessary to form a naphthothiazole nucleus (for example, a naphtho[1,2-d]thiazole nucleus, a naphtho[2,1-d]thiazole nucleus or a naphtho[2,3-d]thiazole nucleus), a benzothiazole nucleus (for example, a 5-chlorobenzothiazole nucleus, a 5-methylbenzothiazole nucleus, a 5,6-dichlorobenzothiazole nucleus, a 5,6-dimethylbenzothiazole nucleus, a 5-phenylbenzothiazole nucleus or a 5-methoxybenzothiazole nucleus), a benzoselenazole nucleus (for example, a 5-chlorobenzoselenazole nucleus, a 5-methylbenzoselenazole nucleus, a 5,6-dimethylbenzoselenazole nucleus, a 5,6-dichlorobenzoselenazole nucleus, a 5-phenylbenzoselenazole nucleus or a 5-methoxybenzoselenazole nucleus) or a naphthoselenazole nucleus (for example, a naphtho[1,2-d]selenazole nucleus, a naphtho[2,1-d]selenazole nucleus or a naphtho[2,3-d]selenazole nucleus), and $Z_2$ represents an atomic group necessary to form a naphthothiazole nucleus (for example, a naphtho[1,2-d]thiazole nucleus, a naphtho[2,1-d]thiazole nucleus, or a naphtho[2,3-d]thiazole nucleus), a benzothiazole nucleus (for example, a 5-chlorobenzothiazole nucleus, a 5-methylbenzothiazole nucleus, a 5,6-dichlorobenzothiazole nucleus, a 5,6-dimethylbenzothiazole nucleus, a 5-phenylbenzothiazole nucleus or a 5-methoxybenzothiazole nucleus), a naphthoselenazole nucleus (for example, a naphtho[1,2-d]selenazole nucleus, a naphtho[2,1-d]selenazole nucleus or a naphtho[2,3-d]selenazole nucleus), a benzoselenazole nucleus (for example, a 5-chlorobenzoselenazole nucleus, a 5-methylbenzoselenazole nucleus, a 5,6-dichlorobenzoselenazole nucleus, a 5,6-dimethylbenzoselenazole nucleus, a 5-phenylbenzoselenazole nucleus or a 5-methoxybenzoselenazole nucleus), a benzimidazole nucleus (for example, a 5-chloro-1-ethylbenzimidazole nucleus, a 5-methyl-1-ethylbenzimidazole nucleus, a 5,6-dichloro-1-ethylbenzimidazole nucleus, a 5,6-1-ethyldimethylbenzimidazole nucleus, an N-ethyl-5-phenylbenzimidazole nucleus or an N-ethyl-5-methoxybenzimidazole nucleus), a benzoxazole nucleus (for example, a 5-chlorobenzoxazole nucleus, a 5-methylbenzoxazole nucleus, a 5,6-dichlorobenzoxazole nucleus, a 5,6-dimethylbenzoxazole nucleus, a 5-phenylbenzoxazole nucleus or a 5-methoxybenzoxazole nucleus) or a naphthoxazole nucleus (for example, a naphtho[1,2-d]oxazole nucleus, a naphtho[2,1-d]oxazole nucleus or a naphtho[2,3-d]oxazole nucleus). When only one alkyl group having a carboxyl group or sulfo group is contained in $R_1$ or $R_2$, $Z_1$ and $Z_2$ contain at least one alkyl group having a sulfo group or carboxyl group. $X_1^-$ represents an acid anion, and m is 1 or 2. The above described sulfo group and carboxyl group may be free or may form a salt. Further, they may have a substituent which is cleft under an alkaline condition (for example, an aminoalkyl group).

Examples of the red-sensitizing dyes represented by general formula (I) are shown below.

(IA)

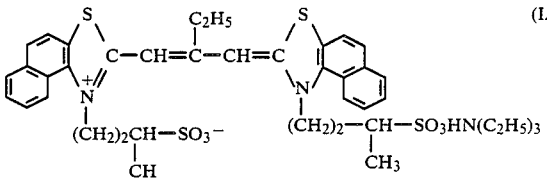

(IB)

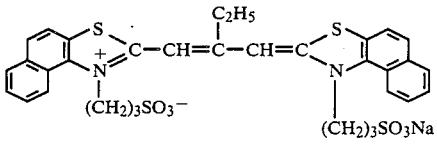

(IC)

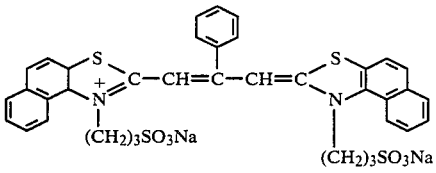

(ID)

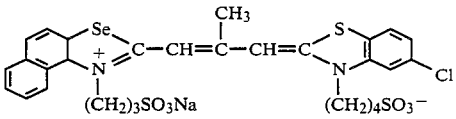

(IE)

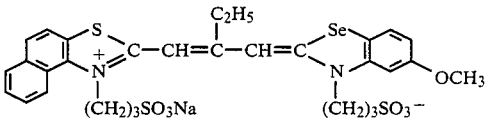

(IF)

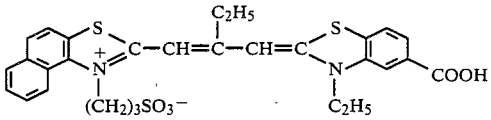

(IG)

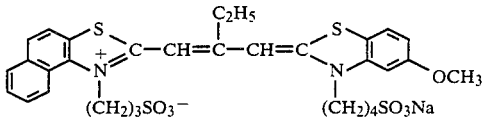

(IH)

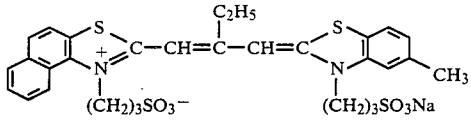

(II)

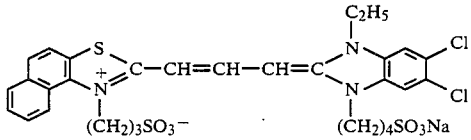

(IJ)

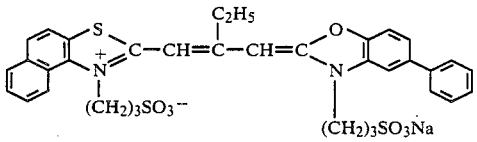

(IK)

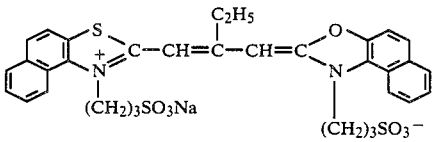

-continued

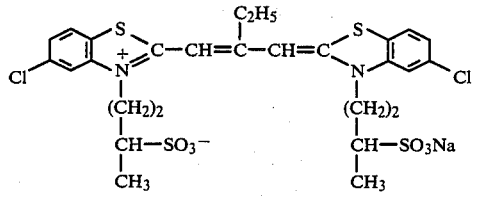

(IL)

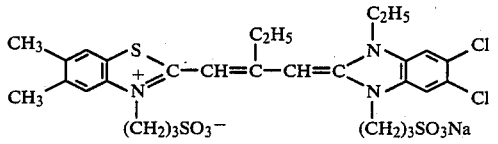

(IM)

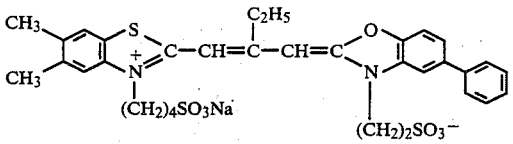

(IN)

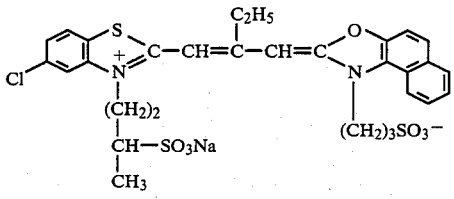

(IO)

The photographic emulsions of the present invention may be spectrally sensitized with methine dyes or others. Examples of dyes used include cyanine dyes, merocyanine dyes, complex cyanine dyes, complex merocyanine dyes, holopolar cyanine dyes, hemicyanine dyes, styryl dyes and hemioxonol dyes. Particularly useful dyes are those belonging to cyanine dyes, merocyanine dyes and complex mercyanine dyes. In these dyes, any nucleus conventionally utilized for cyanine dyes can be applied as the basic heterocyclic nucleus. Namely, it is possible to utilize a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; nuclei in which an alicyclic hydrocarbon ring is fused to the above described nuclei; and nuclei in which an aromatic hydrocarbon ring is fused to the above described nuclei, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus, etc. These nuclei may have substituents on carbon atoms.

In merocyanine dyes and complex mercyanine dyes, it is possible to utilize a 5- or 6-member heterocyclic nucleus such as a pyrazoline-5-one nucleus, a thiohydantoin nucleus, a 2-thiooxazolidine-2,4-dione nucleus, a thiazolidine-2,4-dione nucleus, a rhodanine nucleus or a thiobarbituric acid nucleus, etc., as a nucleus having a ketomethylene structure.

Among them, sensitizing dyes having at least two water-solubilizing groups are particularly useful. Such dyes have been described in the above described Japanese Patent Application No. 10091/83 filed on Jan. 25, 1983 by the present applicant.

These sensitizing dyes may be used alone, but they may be used as a combination of them. The combination of sensitizing dyes is often used for the purpose of supersensitization. Examples of them have been described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78 and Japanese Patent Application (OPI) Nos. 110618/77 and 109925/77 (the term "OPI" as used herein refers to a "published unexamined Japanese patent application").

The emulsions may contain dyes which do not have a spectral sensitization function or substances which do not substantially absorb visible light but show supersensitization function together with the sensitizing dyes.

The photographic emulsion layers in the photographic light-sensitive materials prepared according to the present invention may contain dye image forming couplers (hereinafter referred to as a coupler), namely, compounds which form a dye by reacting with an oxidation product of an aromatic amine developing agent (generally primary amine). As the couplers, it is preferred to use non-diffusible couplers having a hydrophobic group called a ballast group in the molecule. The couplers may be either 4-equivalent or 2-equivalent to silver ions. Further, the emulsion layers may contain colored couplers which have a color correction effect or couplers which release a development inhibitor by development (the so-called DIR coupler). Couplers which form a colorless product by a coupling reaction may be used.

As the yellow couplers, known ring opened ketomethylene type couplers can be used. Among them, benzoylacetanilide compounds and pivaloylacetanilide compounds are advantageous. Examples of the yellow couplers include those described in U.S. Pat. Nos. 2,875,057, 3,265,506, 3,408,194, 3,551,155, 3,582,322, 3,725,072 and 3,891,445, German Pat. No. 1,547,969, German Patent Application (OLS) Nos. 2,219,917, 2,261,361 and 2,414,006, British Pat. No. 1,425,020, Japanese Patent Publication No. 10783/76, and Japanese Patent Application (OPI) Nos. 26133/72, 73147/73, 102636/76, 6341/75, 123342/75, 130442/75, 28127/76, 87650/75, 82424/77 and 115291/77, etc.

As magenta couplers, pyrazolone compounds, indazolone compounds and cyanoacetyl compounds, etc., can be used. Pyrazolone compounds are particularly advantageously used. Examples of the magenta couplers capable of being used include those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, German Pat. No. 1,810,464, German Patent Application (OLS) Nos. 2,408,665, 2,417,945, 2,418,959 and 2,424,467, Japanese Patent Publication Nos. 6031/65 and 45990/76, and Japanese Patent Application (OPI) Nos. 20826/76, 58922/77, 129538/74, 74027/74, 159336/75, 42121/77, 74028/74, 60233/75, 26541/76 and 55122/78, etc.

As cyan couplers, phenol compounds and naphthol compounds, etc., can be used. Examples of them include those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, German Patent Application (OLS) Nos. 2,414,830 and 2,454,329, and Japanese Patent Application (OPI) Nos. 59838/73, 26034/76, 5055/73, 146828/76, 69624/77 and 90932/77.

As colored couplers, it is possible to use those described in U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77, and German Patent Application (OLS) No. 2,418,959, etc.

As DIR couplers, it is possible to use those described in, for example, U.S. Pat. Nos. 3,227,554, 3,617,291, 3,701,783, 3,790,384 and 3,632,345, German Patent Application (OLS) Nos. 2,414,006, 2,454,301 and 2,454,329, British Pat. No. 953,454, Japanese Patent Application (OPI) Nos. 69624/77 and 12335/74, and Japanese Patent Publication No. 15141/76.

Compounds which release a development inhibitor by development, other than the DIR couplers, may be contained in the light-sensitive materials. For example, it is possible to use those described in U.S. Pat. Nos. 3,297,445 and 3,379,529, German Patent Application (OLS) No. 2,417,914, and Japanese Patent Application (OPI) Nos. 15271/77 and 9116/78.

Two or more kinds of the above described couplers may be contained in the same layer. The same compound may be contained in two or more different layers.

These couplers are generally added in an amount of $2\times10^{-3}$ mol to $5\times10^{-1}$ mol, preferably $1\times10^{-2}$ mol to $5\times10^{-1}$ mol, per mol of silver in the emulsion layer.

In order to introduce the above described couplers into the silver halide emulsion layers, known processes, for example, the process described in U.S. Pat. No. 2,322,027 can be used. For example, they are dispersed in hydrophilic colloids after being dissolved in phthalic acid alkyl esters (dibutyl phthalate or dioctyl phthalate, etc.), phosphoric acid esters (diphenyl phosphate, triphenyl phosphate, tricresyl phosphates of dioctylbutyl phosphates), citric acid esters (for example, tributyl acetylcitrate), benzoic acid esters (for example, octyl benzoate), alkylamides (for example, diethyllaurylamide) or aliphatic acid esters (for example, dibutoxyethyl succinate or dioctyl azelate), etc., or organic solvents having a boiling point of about 30° C. to 150° C. such as lower alkyl acetate (for example, ethyl acetate or butyl acetate), ethyl propionate, secondary butyl alcohol, methyl isobutyl ketone, β-ethoxyethyl acetate or methyl cellosolve, etc. The above described organic solvents having a high boiling point and the organic solvent having a low boiling point may be used as a mixture of them.

When the couplers have acid groups such as a carboxylic acid or sulfonic acid group, they are introduced into the hydrophilic colloids as an alkaline aqueous solution.

As binders or protective colloids for the photographic emulsions, gelatin is advantageously used, but other hydrophilic colloids can be used, too.

For example, it is possible to use proteins such as gelatin derivatives, graft polymers of gelatin with other high polymers, albumin or casein, etc.; cellulose derivatives such as hydroxyethyl cellulose, carboxymethyl cellulose or cellulose sulfate, etc.; saccharose derivatives such as sodium alginate or starch derivatives, etc.; and various synthetic hydrophilic high molecular substances such as homopolymers or copolymers, such as polyvinyl alcohol, polyvinyl alcohol partial acetal, poly-N-vinylpyrrolidone, polyacrylic acid, polymethacrylic acid, polyacrylamide, polyvinylimidazole or polyvinylpyrazole, etc.

As the gelatin, it is possible to use not only lime treated gelatin, but also acid treated gelatin, enzyme treated gelatin described in *Bull. Soc. Sci. Phot. Japan*, No. 16, page 30 (1966) and hydrolyzed products or enzymatic products of gelatin. As gelatin derivatives, it is possible to use those prepared by reacting gelatin with various kinds of compounds such as acid halides, acid anhydrides, isocyanates, bromoacetic acid, alkanesultones, vinylsulfonamides, maleinimide compounds, polyalkylene oxides or epoxy compounds, etc. Examples of them have been described in U.S. Pat. Nos. 2,614,928, 3,132,945, 3,186,846 and 3,312,553, British Pat. Nos. 861,414, 1033,189 and 1,005,784, and Japanese Patent Publication No. 26845/67, etc.

As the above described gelatin graft polymers, it is possible to use those prepared by grafting a homopolymer or copolymer of vinyl monomers such as acrylic acid, methacrylic acid or derivatives thereof such as esters or amides, etc., acrylonitrile or styrene, etc., on a gelatin. It is particularly preferred to use graft polymers prepared by grafting a polymer having a certain degree of compatibility with gelatin, such as polymer of acrylic acid, methacrylic acid, acrylamide, methacrylamide or hydroxyalkyl methacrylate, etc., on a gelatin. Examples of them have been described in U.S. Pat. Nos. 2,763,625, 2,831,767 and 2,956,884, etc.

Typical synthetic hydrophilic high molecular substances are those described in, for example, German Patent Application (OLS) No. 2,312,708, U.S. Pat. Nos. 3,620,751 and 3,879,205 and Japanese Patent Publication No. 7561/68.

In the light-sensitive materials of the present invention, the hydrophilic colloid layers may contain water-soluble dyes as filter dyes or for preventing irradiation or for other various purposes. Examples of such dyes include oxonol dyes, hemioxonol dyes, styryl dyes, merocyanine dyes, cyanine dyes and azo dyes. Particularly, oxonol dyes, hemioxonol dyes and merocyanine dyes are useful. Examples of dyes capable of being used include those described in British Pat. Nos. 584,609 and 1,177,429, Japanese Patent Application (OPI) Nos. 85130/73, 99620/74, 114420/74 and 108115/77, and U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352.

In the light-sensitive materials of the present invention, when the hydrophilic colloid layers contain dyes or ultraviolet ray absorbing agents, etc., they may be mordanted with cationic polymers. For example, it is possible to use polymers described in British Pat. No. 685,475, U.S. Pat. Nos. 2,675,316, 2,839,401, 2,882,156, 3,048,487, 3,184,309 and 3,445,231, German Patent Application (OLS) No. 1,914,362, and Japanese Patent Application (OPI) Nos. 47624/75 and 71332/75, etc.

In the light-sensitive materials of the present invention, the hydrophilic colloid layers may contain ultraviolet ray absorbing agents. For example, it is possible to use benzotriazole compounds substituted by an aryl group (for example, those described in U.S. Pat. No. 3,533,794), 4-thiazolidone compounds (for example, those described in U.S. Pat. Nos. 3,314,794 and 3,352,681), benzophenone compounds (for example, those described in Japanese Patent Application (OPI) No. 2784/71), cinnamic acid esters (for example, those described in U.S. Pat. Nos. 3,705,805 and 3,707,375), butadiene compounds (for example, those described in U.S. Pat. No. 4,045,229), and benzoxazole compounds (for example, those described in U.S. Pat. No. 3,700,455). Further, those described in U.S. Pat. No. 3,499,762 can be used. Ultraviolet ray absorbing couplers (for example, α-naphthol type cyan dye forming couplers) and ultraviolet ray absorbing polymers may be used, too. These ultraviolet ray absorbing agents may be mordanted in the specified layer.

The light-sensitive materials prepared by the present invention may contain hydroquinone derivatives, aminophenol derivatives, gallic acid derivatives and ascorbic acid derivatives, etc., as anti-color-fogging agents. Examples of them have been described in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75, 110337/75 and 146235/77 and Japanese Patent Publication No. 23813/75, etc.

In carrying out the present invention, the following known antifading agents can be used together, and the dye image stabilizers can be used alone or as a combination of two or more of them. Examples of the known antifading agents include hydroquinone derivatives described in U.S. Pat. Nos. 2,360,290, 2,418,613, 2,675,314, 2,701,197, 2,704,713, 2,728,659, 2,732,300, 2,735,765, 2,710,801 and 2,816,028 and British Pat. No. 1,363,921, etc., gallic acid derivatives described in U.S. Pat. Nos. 3,457,079 and 3,069,262, etc., p-alkoxyphenols described in U.S. Pat. Nos. 2,735,765 and 3,698,909, and Japanese Patent Publication Nos. 20977/74 and 6623/77, p-oxyphenol derivatives described in U.S. Pat. Nos. 3,432,300, 3,573,050, 3,574,627 and 3,764,337 and Japanese Patent Application (OPI) Nos. 35633/77, 147434/77 and 152225/77, and bisphenols described in U.S. Pat. No. 3,700,455, etc.

After the color reversal light-sensitive material of the present invention are imagewise exposed to light, they are subjected to processings of black-and-white development, optical or chemical fogging, color development, bleaching and fixation.

As a developing solution used for black-and-white development processing in the present invention (hereinafter referred to as black-and-white developing solution), any developing solution can be used, if it is composed of the known composition. Examples of the developing agent for the black-and-white developing solution include N-methyl-p-aminophenol hemisulfate, 1-phenyl-3-pyrazolidone, hydroquinone and 4,4-dimethyl-1-phenyl-3-pyrazolidone, etc. Further, it is possible to use inorganic and organic developing agents described in *The Theory of the Photographic Process* (Third Edition), edited by Mees, (published by Macmillan Co., 1967).

The black-and-white developing solution can contain other known components for development. For example, caustic soda, caustic potash, sodium carbonate, potassium carbonate, sodium tertiary phosphate, potassium tertiary phosphate, potassium metaborate and borax, etc., are used alone or as a combination of them as alkali agents or buffer agents. Further, silver halide solvents such as sodium thiosulfate, potassium thiosulfate, sodium thiocyanate or potassium thiocyanate, etc., are used for the purpose described in British Pat. No. 1,579,511. Further, various salts such as disodium hydrogen phosphate, dipotassium hydrogen phosphate, alkali borate, alkali nitrate or alkali sulfate, etc., are used for the purpose of giving buffer ability, for the reason of preparation or for the purpose of increasing ion strength, etc.

If necessary, suitable development accelerators can be added to the black-and-white developing solution. For example, it is possible to use various pyridinium compounds and other cationic compounds, cationic dyes such as phenosafranine, and neutral salts such as thallium nitrate or potassium nitrate, as described in U.S. Pat. No. 2,648,604, Japanese Patent Publication No. 9503/69 and U.S. Pat. No. 3,671,247, nonionic compounds such as polyethylene glycol or derivatives thereof or polythioethers, etc., as described in Japanese Patent Publication No. 9504/69 and U.S. Pat. Nos. 2,533,990, 2,531,832, 2,950,970 and 2,577,127, organic solvents, organic amines, ethanolamine, ethylenediamine and diethanolamine, etc., as described in Japanese Patent Publication No. 9509/69 and Belgian Pat. No. 682,862, and accelerators described in L. F. A. Mason, *Photographic Processing Chemistry,* pages 40 to 43 (Focal Press, London, 1966). In addition, benzyl alcohol and phenylethyl alcohol described in U.S. Pat. No. 2,515,147 and pyridine, ammonia, hydrazine and amines, etc., described in *Nippon Shashin Gakkaishi,* Volume 14, page 74 (1952) are useful development accelerators.

Further, it is possible to add sodium sulfite, potassium sulfite, potassium bisulfite and sodium bisulfite which are used generally as preservatives.

In the present invention, if necessary, suitable antifogging agents can be added to the black-and-white developing solution. As the antifogging agents, alkali metal halides such as potassium bromide, sodium bromide or potassium iodide and organic antifoggants can be used. As the organic antifoggants, it is possible to use nitrogen containing heterocyclic compounds such as benzotriazole, 6-nitrobenzimidazole, 5-nitroisoindazole, 5-methylbenzotriazole, 5-nitrobenzotriazole or 5-chlorobenzotriazole, mercapto substituted heterocyclic compounds such as 1-phenyl-5-mercaptotetrazole, 2-mercaptobenzimidazole or 2-mercaptobenzothiazole, and mercapto substituted aromatic compounds such as thiosalicylic acid. Particularly preferred compounds are nitrogen containing heterocyclic compounds and preferably those which are not substituted by mercapto groups. They are added in an amount of 1 mg to 5 g, preferably 5 mg to 1 g, per liter of the color developing solution.

Moreover, polyphosphoric acid compounds such as sodium hexametaphosphate, sodium tetrapolyphosphate or sodium tripolyphosphate or potassium salts of the above described polyphosphoric acids, etc., and aminopolycarboxylic acids such as ethylenediaminetetraacetic acid, nitrilotriacetic acid, cyclohexanediaminetetraacetic acid, iminodiacetic acid or diethylenetriaminepentaacetic acid, etc., can be used as water softeners. The amount of them depends upon the hardness of the water to be used, but they are generally used in an amount of 0.5 to 1 g/l. In addition, calcium or magnesium concealing agents can be used for the black-and-white developing solution. They have been described in detail in *Belgische Chemische Industrie,* by J. Willems, Volume 21, page 325 (1956) and Volume 23, page 1105 (1958).

In order to fog silver halide remaining in the light-sensitive materials after the black-and-white development processing in the present invention, a fogging bath containing a fogging agent is provided specially or a fogging agent is added to the color development bath to carry out color development with fogging. Further, a method of reexposing to light may be used instead of the chemical fogging method using the fogging agent.

As fogging agents, it is possible to use alkali metal borohydrides (for example, sodium borohydride or potassium borohydride), amine boranes (for example, t-butylamine borane or ethylenediamine diborane), and tin-aminopolycarboxylic acid complex salts (for example, disodium ethylenediaminetetraacetato tin complex, sodium nitrilotriacetato tin complex or N-hydroxyethylethylenediaminetriacetato tin complex). Further, it is possible to utilize complex salts of tin and organic acid, such as tin (II) chelate of ethylenediamine-N,N,N',N'-tetramethylenephosphonic acid, tin (II) chelate of nitrilo-N,N,N-trimethylenephosphonic acid, tin (II) chelate of 1-hydroxyethylidene-1,1-diphosphonic acid, Sn (II) complex salt of β-glycerophosphoric acid, Sn (II) complex salt of o-phosphoethanolamine, Sn (II) complex salt of citric acid, Sn (II) complex salt of tartaric acid, Sn (II) complex salt of pyrophosphoric acid, Sn (II) complex salt of hexametaphosphoric acid, Sn (II) complex salt of 2-phosphonobutane-2,3,4-tricarboxylic acid and Sn (II) complex salt of 2,2-diphosphonobutane-3,4-dicarboxylic acid, etc.

Further, compounds described in Japanese Patent Publication No. 38816/72 are useful.

The color developing solution used in the present invention has a composition of the conventional color developing solution containing an aromatic primary amine developing agent. Preferred examples of the aromatic primary amine color developing agents are p-phenylenediamine derivatives as described in the following. Namely, preferred examples include N,N-diethyl-p-phenylenediamine hydrochloride, 2-amino-5-diethylaminotoluene hydrochloride, 2-amino-5-(N-ethyl-N-laurylamino)-toluene hydrochloride, 4-[N-ethyl-N-(β-hydroxyethyl)-amino]aniline sulfate, 2-methyl-4-[N-ethyl-N-(β-hydroxyethyl)amino]aniline sulfate, N-ethyl-N-(β-methanesulfon-amidoethyl)-3-methyl-4-aminoaniline sesquisulfate monohydrate described in U.S. Pat. No. 2,193,015, N-(2-amino-5-diethylaminophenylethyl)methanesulfonamide sulfate described in U.S. Pat. No. 2,592,364, N,N-dimethyl-p-phenylenediamine hydrochloride, and 4-amino-3-methyl-N-ethyl-N-methoxyethylaniline, 4-amino-3-methyl-N-ethyl-N-β-ethoxyethylaniline and 4-amino-3-methyl-N-ethyl-N-β-butoxyethylaniline and salts of them (for example, sulfates, hydrochlorides, sulfites or p-toluene-sulfonates, etc.) described in U.S. Pat. Nos. 3,656,950 and 3,698,525, etc.

In addition, any of the above described compounds capable of adding to the black-and-white developing solution can be added to the color developing bath.

Furthermore, competing couplers may be added to the color developing bath.

As the competing couplers, citrazinic acid, J-acid and H-acid, etc., are suitable. Further, compounds described in, for example, U.S. Pat. No. 2,742,832, Japanese Patent Publication Nos. 9504/69, 9506/69 and 9507/69, and U.S. Pat. Nos. 3,520,690, 3,560,212 and 3,645,737, etc., can be used.

The color development processing is carried out at pH 8 or more, preferably in a range of pH 9 to 12.

The reversal processing of the present invention generally consists of:

(1) black-and-white development→stopping→water washing→fogging→(water washing)→color development→stopping→(water washing)→bleach→(water washing)→fixation→water washing→stabilization→drying (2) black-and-white development→stopping→water washing→fogging→(water washing)→color development→stopping→(water washing)→bleach-fixation→water washing→stabilization→drying In the processes (1) and (2), it is possible to provide a previous bath, a prehardening bath and a neutralization bath, etc. In the above described processes, the stabilization bath and the water washing described in the parenthesis after bleach can be omitted. Further, the stopping bath after the black-and-white development can be omitted according to circumstances. The fogging bath can be replaced with reexposure, or the fogging bath can be omitted by adding the fogging agent to the color developing solution. Any bleaching bath, fixation bath, bleach-fixation bath and stabilizing bath may be used, if they have known compositions.

In the method of photographic processing according to the present invention, though the above described processes (1) and (2) are useful, the present invention is not limited to these processes.

The above described processing is preferred to be carried out at 25° C. to 50° C.

In the following, the present invention will be illustrated in greater detail.

EXAMPLE

To a triacetate film base, the 1st layer to the 13th layer were applied in the following order to produce a color reversal photographic light-sensitive material.

The 1st Layer: Antihalation Layer (A gelatin layer containing black colloidal silver)

The 2nd Layer: Gelatin Intermediate Layer

The 3rd Layer: Low-Speed Red-Sensitive Emulsion Layer [To a low-speed silver iodobromide emulsion which was subjected to gold-sulfur sensitization (silver iodide: 3.6% by mol, average particle size: about 0.3μ), A sensitizing dye (5,5'-dichloro-9-ethyl-3,3'-disulfobutyloxacarbocyanine sodium salt)

and

A cyan coupler emulsion (coupler: 2-(heptafluorobutyramido)-5-[2'-(2'',4''-di-t-aminophenoxy)butyramido]-phenol, coupler solvent: tricresyl phosphate)

were added. The resulting low-speed red-sensitive emulsion was applied so as to result in a coating silver amount of 0.9 g/m$^2$.]

The 4th Layer: High-Speed Red-Sensitive Emulsion Layer [To a high-speed silver iodobromide emulsion which was subjected to gold-sulfur sensitization (silver iodide: 3.6% by vol, average particle size: about 0.5μ), the same sensitizing dye and the same cyan coupler emulsion as in the 3rd layer were added. The resulting high-speed red-sensitive emulsion was applied so as to result in a coating silver amount of 0.4 g/m$^2$.]

The 5th Layer: Gelatin Intermediate Layer

The 6th Layer: Intermediate Layer [A silver bromide emulsion the surface of which was previously fogged (average particle size: about 0.15μ) was applied so as to result in a coating silver amount of 0.03 g/m$^2$ and a coating gelatin amount of 0.4 g/m$^2$.]

The 7th Layer: Low-Speed Green-Sensitive Emulsion Layer [A low-speed silver iodobromide emulsion (I) which was subjected to gold-sulfur sensitization (silver iodide: 2.8% by mol, average particle size: about 0.2μ) and a low-speed silver iodobromide emulsion (II) which was subjected to gold-sulfur sensitization (silver iodide: 2.8% by mol, average particle size: about 0.5μ) were blended in a ratio of (I)/(II)≈2/1 by weight of silver. In the resulting mixed emulsion, the content of fine grain silver halide having a particle size of 0.3μ or less was about 70% of the total number of grains. To this mixed emulsion, A sensitizing dye (5,5'-diphenyl-9-ethyl-3,3'-disulfopropyloxacarbocyanine sodium salt)

and

A magenta coupler emulsion (coupler: 1-(2,4,6-trichlorophenyl)-3-[3-(2,4-di-t-amylphenoxyacetamido)benzamido]-5-pyrazolone, coupler solvent: tricresyl phosphate) were added. The resulting low-speed green-sensitive emulsion was applied so as to result in a coating silver amount of 1.0 g/m².]

The 8th Layer: High-Speed Green-Sensitive Emulsion Layer [To a high-speed silver iodobromide emulsion which was subjected to gold-sulfur sensitization (silver iodide: 2.6% by mol, average particle size: about 0.9μ), the same sensitizing dye and the same magenta coupler emulsion as in the 7th layer were added. The resulting high-speed green-sensitive emulsion was applied so as to result in a coating silver amount of 0.6 g/m². ]

The 9th Layer: Gelatin Intermediate Layer

The 10th Layer: Yellow Filter Layer (A gelatin layer containing yellow colloidal silver)

The 11th Layer: Low-Speed Blue-Sensitive Emulsion Layer [To a low-speed silver iodobromide emulsion which was subjected to gold-sulfur sensitization (silver iodide: 3.7% by mol, average particle size: about 0.4μ), A yellow coupler emulsion (coupler: α-pivaloyl-α-(1-benzyl-5-ethoxy-3-hydantoinyl)-2-chloro-5-hexadecylsulfonylaminoacetanilide, coupler solvent: triisononyl phosphate) was added. The resulting low-speed blue-sensitive emulsion was applied so as to result in a coating silver amount of 0.9 g/m².]

The 12th Layer: High-Speed Blue-Sensitive Emulsion Layer [To a high-speed silver iodobromide emulsion which was subjected to gold-sulfur sensitization (silver iodide: 2.6% by mol, average particle size: about 1.0μ), the same yellow coupler emulsion as in the 11th layer was added. The resulting high-speed blue-sensitive emulsion was applied so as to result in a coating silver amount of 0.6 g/m².]

The 13th Layer: Gelatin Protective Layer

But, to each emulsion layer described above, the following agents were further added in turn:

Stabilizer: 4-Hydroxy-6-methyl-1,3,3a,7-tetraazaindene

Hardener: 1,3-Bisvinylsulfonylhydroxypropane

Coating Aid:

[Sodium p-dodecylbenzenesulfonate, and sodium p-nonylphenoxy poly(ethyleneoxy)propanesulfonate]

and the emulsions were applied to produce Sample 1 (for comparison).

Sample 2 (the present invention) was produced by the same manner as described above, except that the low-speed silver iodobromide emulsion (I) in the low-speed green-sensitive emulsion layer (the 7th layer) was replaced with the following low-speed silver iodobromide emulsion (III).

Low-Speed Silver Iodobromide Emulsion (III): [A silver iodobromide emulsion (silver iodide: 2.8% by mol, average particle size: about 0.2μ) which was prepared by the same manner as in the low-speed silver iodobromide emulsion (I) except that α-methylthio-5-mercapto-1,3,4-thiadiazole was added to the silver iodobromide emulsion in an amount of 0.08 g per mol of silver when grains of the low-speed silver iodobromide emulsion (I) were formed. To the thus-prepared low-speed silver iodobromide emulsion (III), the low-speed silver iodobromide emulsion (II) was added in a ratio (III)/(II)≈2/1 by weight of silver. The content of grains having a particle size of 0.3μ or less in the resulting mixed emulsion was about 70% of the total number of grains.]

Samples 1 and 2 were exposed to light through a light wedge. Thereafter, they were subjected to the following color reversal development processing.

Processing:

| Process | Time | Temperature |
|---|---|---|
| The 1st Development | 2 Minutes<br>6 Minutes<br>10 Minutes | 38° C. |
| Water Washing | 2 Minutes | " |
| Reversal (fogging) | 2 Minutes | " |
| Color Development | 6 Minutes | " |
| Adjustment | 2 Minutes | " |
| Bleach | 6 Minutes | " |
| Fixation | 4 Minutes | " |
| Water Washing | 4 Minutes | " |
| Stabilization | 1 Minute | Room Temperature |
| Drying | | |

Each processing solution had the following compositions.

| | |
|---|---|
| **The 1st Developing Solution:** | |
| Water | 700 ml |
| Sodium Tetrapolyphosphate | 2 g |
| Sodium Sulfite | 20 g |
| Hydroquinone Monosulfonate | 30 g |
| Sodium Carbonate (monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% solution) | 2 ml |
| Water to make | 1,000 ml (pH 10.1) |
| **Reversal Solution:** | |
| Water | 700 ml |
| Nitrilo-N,N,N—trimethylenephosphonic Acid 6Na Salt | 3 g |
| Stannous Chloride (2 hydrate) | 1 g |
| p-Aminophenol | 0.1 g |
| Sodium Hydroxide | 8 g |
| Glacial Acetic Acid | 15 ml |
| Water to make | 1,000 ml |
| **Color Developing Solution:** | |
| Water | 700 ml |
| Sodium Tetrapolyphosphate | 2 g |
| Sodium Sulfite | 7 g |
| Sodium Tertiary Phosphate (12 hydrate) | 36 g |
| Potassium Bromide | 1 g |
| Potassium Iodide (0.1% solution) | 90 ml |
| Sodium Hydroxide | 3 g |
| Citrazinic Acid | 15 g |
| N—Ethyl-N—(β-methanesulfonamidoethyl)-3-methyl-4-aminoaniline Sulfate | 11 g |
| Ethylenediamine | 3 g |
| Water to make | 1,000 ml |
| **Adjustment Solution:** | |
| Water | 700 ml |
| Sodium Sulfite | 12 g |
| Sodium Ethylenediaminetetraacetate (2 hydrate) | 8 g |

-continued

| | |
|---|---|
| Thioglycerine | 0.4 ml |
| Glacial Acetic Acid | 3 ml |
| Water to make | 1,000 ml |
| Bleaching Solution: | |
| Water | 800 ml |
| Sodium Ethylenediaminetetraacetate (2 hydrate) | 2.0 g |
| Ethylenediaminetetraacetato Iron (III) Ammonium Complex (2 hydrate) | 120.0 g |
| Potassium Bromide | 100.0 g |
| Water to make | 1,000 ml |
| Fixing Solution: | |
| Water | 800 ml |
| Ammonium Thiosulfate | 80.0 g |
| Sodium Sulfite | 5.0 g |
| Sodium Bisulfite | 5.0 g |
| Water to make | 1,000 ml |
| Stabilizing Solution: | |
| Water | 800 ml |
| Formalin (37% by weight) | 5.0 ml |
| Fuji Driwel | 5.0 ml |
| Water to make | 1,000 ml |

The magenta image densities of Samples 1 and 2 were measured to obtain the D-log E characteristic curves shown in the FIGURE.

In the FIGURE, the broken line a' indicates the result in case of carrying out the 1st development of Sample 1 for 2 minutes, the broken line b' indicates the result in case of carrying out the 1st development of Sample 1 for 6 minutes, and the broken line c' indicates the result in case of carrying out the 1st development of sample 1 for 10 minutes.

Further, in the FIGURE, the solid line a indicates the result in case of carrying out the 1st development of Sample 2 for 2 minutes, the solid line b indicates the result in case of carrying out the 1st development of Sample 2 for 6 minutes, and the solid line c indicates the result in case of carrying out the 1st development of Sample 2 for 10 minutes.

The FIGURE shows that in Sample 1 (comparison) as shown by broken lines a', b' and c', the dye image density in the area where an image exposure amount is large remarkably reduces as time increases during the 1st development, and the characteristic curve in the high exposure area on the whole becomes lacking in linearity. Further, it is understood that, in the foot part of the characteristic curves, gradation becomes soft tone. On the contrary, in Sample 2 (the present invention) as shown by solid lines a, b and c, the dye image density in the area where the image exposure amount is large is remarkably high as compared with Sample 1, and the characteristic curve in the high exposure area on the whole has very good linearity. Further, it is understood that the foot part of characteristic curves becomes hard tone. Accordingly, it is obvious that Sample 2 of the present invention has remarkably excellent exposure latitude as compared with Comparative Sample 1 and has very correct tone reproduction in the high exposure area.

While the invention has been described in detail and with reference to specific embodiments thereof, it will be apparent to one skilled in the art that various changes and modifications can be made therein without departing from the spirit and scope thereof.

What is claimed is:

1. A color reversal photographic light-sensitive material, comprising:

a support base having thereon:

a silver halide emulsion layer comprised of a mixture of fine grain silver halide latent image forming particles having a particle size of 0.3μ or less, the fine grain particles being present in the emulsion in an amount in the range of about 30% to about 95% based on the total number of silver grains in the emulsion layer, and coarse grain silver halide latent image forming particles having a particle size of more than 0.3μ;

an organic compound present in the emulsion layer, the compound being an additive for improving tone reproduction and having a solubility product constant of $10^{-14}$ or less when forming a salt with a silver ion; and colloid grains of an ingredient selected from the group consisting of metal, a metal sulfide and silver halide grains the surface of which is previously fogged, the colloid grains being present in a layer selected from the group consisting of the silver halide emulsion layer and a hydrophilic colloid layer, wherein said organic compound is a heterocyclic mercapto compound.

2. A color reversal photographic light-sensitive material as claimed in claim 1, further comprising a second silver halide emulsion layer having the same color sensitivity property as the silver halide emulsion layer, the second silver halide emulsion layer having a higher sensitivity than the emulsion layer and being superposed in combination with the emulsion layer.

3. A color reversal photographic light-sensitive material as claimed in claim 1, wherein the organic compound has a solubility product constant of $10^{-15}$ or less when forming a salt with a silver ion.

4. A color reversal photographic light-sensitive material as claimed in claim 1, wherein the organic compound is a 5-mercapto-1,3,4-thiadiazole derivative.

5. A color reversal photographic light-sensitive material as claimed in claim 1, wherein the fine grain silver halide is present in the silver halide emulsion layer in an amount of about 40% to about 90% of the total number of silver halide grains in the emulsion layer.

6. A color reversal photographic light-sensitive material as claimed in claim 1, wherein 90% or more of the number of grains having a particle size of 0.3μ or less have a particle size in the range of 0.3μ to 0.15μ.

7. A color reversal photographic light-sensitive material as claimed in claim 1, wherein 90% or more of the total number of grains of the fine grain silver halide have an average particle size within ±40% of the average particle size of the fine grain silver halide emulsion.

8. A color reversal photographic light-sensitive material as claimed in claim 7, wherein 90% or more of the fine grain silver halide particles have a particle size in the range of ±30% of the average particle size of the fine grain silver halide emulsion.

9. A color reversal photographic light-sensitive material as claimed in claim 1, wherein the fine grain silver halide particles have a particle size of 0.25μ or less.

10. A color reversal photographic light-sensitive material as claimed in claim 1, wherein the coarse grain silver halide particles have a particle size in the range of 0.35μ to 0.7μ.

11. A color reversal photographic light-sensitive material as claimed in claim 1, wherein the organic compound is present in an amount in the range of $10^{-6}$ mg to 1 mg per 1 $dm^2$ of support base.

12. A color reversal photographic light-sensitive material as claimed in claim 11, wherein the organic compound is present in an amount in the range of $10^{-4}$ mg to $10^{-2}$ mg per 1 $dm^2$ of the support base.

13. A color reversal photographic light-sensitive material according to claim 1, wherein the organic compound is a 2-mercaptobenzimidazole compound, a 2-mercaptobenzothiazole compound, a 2-mercaptobenzoxazole compound or a 5-mercaptothiadiazole compound.

14. A color reversal photographic light-sensitive material according to claim 1, wherein the organic compound is a compound represented by general formula

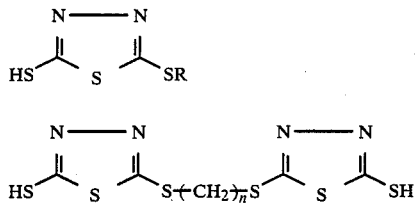

wherein R represents an alkyl group or an aralkyl group and n represents an integer of 2 to 10.

15. A color reversal photographic light-sensitive material according to claim 14, wherein the alkyl group has 1 to 4 carbon atoms and the alkyl moiety of the aralkyl group has 1 to 4 carbon atoms.

16. A color reversal photographic light-sensitive material according to claim 1, wherein the organic compound is a compound represented by one of formulae (1), (2), (3), (4), (5) or (6)

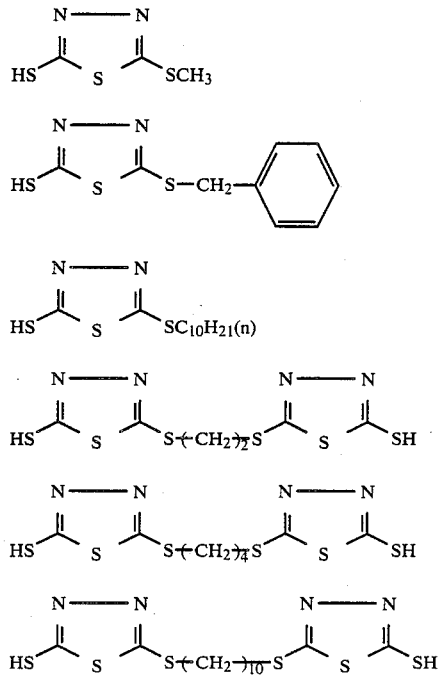

* * * * *